United States Patent [19]

Tanaka

[11] Patent Number: 4,556,879

[45] Date of Patent: Dec. 3, 1985

[54] VIDEO DISPLAY APPARATUS

[75] Inventor: Kazuyuki Tanaka, Kamakura, Japan

[73] Assignee: Matsushita Electric Industrial Co., Ltd., Osaka, Japan

[21] Appl. No.: 363,792

[22] Filed: Mar. 31, 1982

[30] Foreign Application Priority Data

Apr. 6, 1981 [JP] Japan ..... 56-51478

[51] Int. Cl.[4] ..... G09G 1/00

[52] U.S. Cl. ..... 340/750; 340/799; 340/747; 340/748

[58] Field of Search ..... 340/750, 721, 798, 799, 340/800, 744, 747, 748

[56] References Cited

U.S. PATENT DOCUMENTS 3,624,632 11/1971 Opair ..... 340/745
3,849,773 11/1974 Katahira et al. ..... 340/745
4,197,590 4/1980 Sukonick et al. ..... 340/750 X
4,388,621 6/1983 Komatsu et al. ..... 340/750 X

*Primary Examiner*—Marshall M. Curtis
*Assistant Examiner*—Vincent P. Kovalick
*Attorney, Agent, or Firm*—Stevens, Davis, Miller & Mosher

[57] ABSTRACT

In a video display apparatus which includes a video random access memory storing data of characters and graphics to be displayed on a cathode-ray tube display unit of raster scan type and in which display data corresponding to display positions on the cathode-ray tube display unit are read out from the video random access memory and are then subjected to parallel-serial conversion to provide a video signal applied to the cathode-ray tube display unit, the display data are read out from the video random access memory utilizing the page read function so that an inexpensive dynamic random access memory can be used as the video random access memory.

2 Claims, 6 Drawing Figures

VIDEO DISPLAY APPARATUS

BACKGROUND OF THE INVENTION

This invention relates to a video display apparatus which includes a video random access memory (referred to hereinafter as a video RAM) storing data for determining in a 1:1 relation characters and graphics which are to be displayed on a display unit provided with a cathode-ray tube of raster scan type and in which data corresponding to display positions on the cathode-ray tube are read out from the video RAM and are converted by a parallel-serial converter into a video signal which is supplied to the cathode-ray tube.

SUMMARY OF THE INVENTION

It is a primary object of the present invention to provide a video display apparatus in which an inexpensive dynamic random access memory (referred to hereinafter as dynamic RAM) having a long cycle time can be used as the video RAM.

DESCRIPTION OF THE PREFERRED EMBODIMENT

Figure 1:
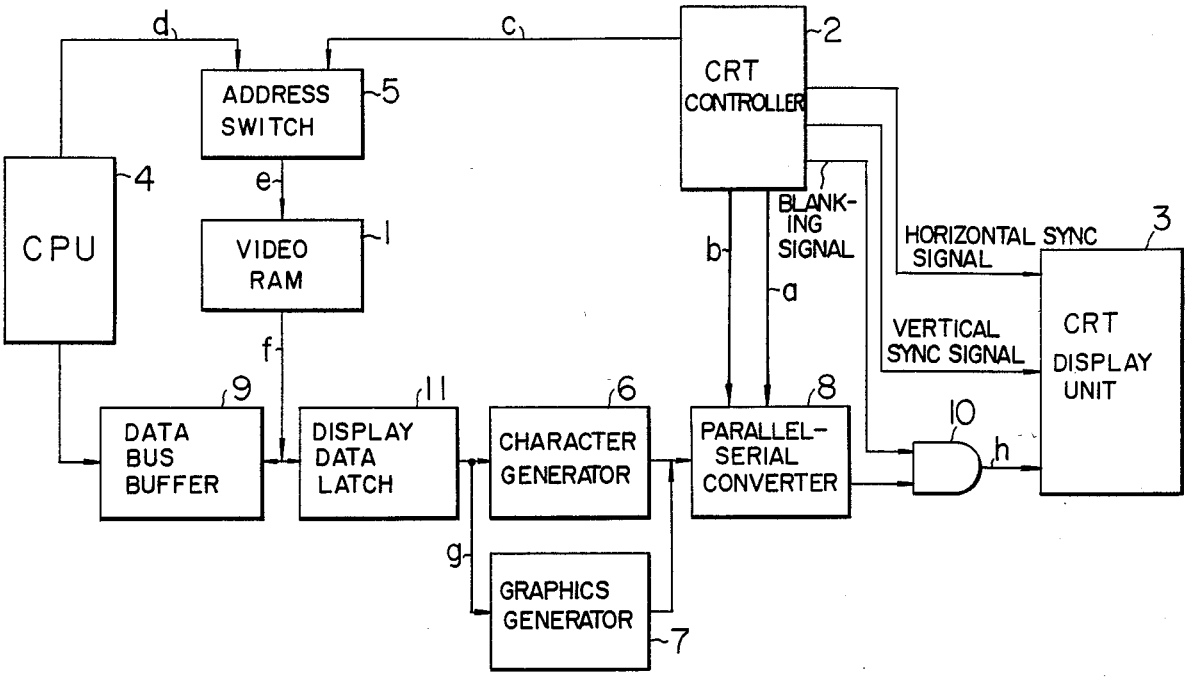
FIG. 1 PRIOR ART
FIG. 1 is a block diagram of a prior art video display apparatus.

For a better understanding of the present invention, the construction of a prior art video display apparatus will be described with reference to FIG. 1 before describing the present invention in detail. Referring to FIG. 1, the prior art video display apparatus includes a video RAM 1 for storing data for determining in a 1:1 relation characters and graphics which are to be displayed on a cathode-ray tube (CRT) display unit 3, a CRT controller 2 applying a display address signal c indicative of the position of display on the CRT display unit 3 to the video RAM 1, and also applying a horizontal synchronizing signal, a vertical synchronizing signal and a blanking signal to the CRT display unit 3, and a central processing unit (CPU) 4 applying a memory read-write address signal signal d to the video RAM 1 for displaying a sentence or graphics on the CRT display unit 3. An address switch 5 switches between the display address signal c applied from the CRT controller 2 and the memory read-write address signal d applied from the CPU 4. A character generator 6 generates a character signal by converting a display data signal f applied from the video RAM 1 into parallel bits so that the character represented by the display data signal f can be displayed on the CRT display unit 3. A graphics generator 7 generates a graphics signal by converting a display data signal f applied from the video RAM 1 into parallel bits so that the graphics represented by the display data signal f can be displayed on the CRT display unit 3. A parallel-serial converter 8 converts the parallel data signal applied from the character generator 6 or from the graphics generator 7 into a serial data signal to provide a video signal h to be applied to the CRT display unit 3. A data bus buffer 9 is provided for separation between a cpu data signal applied from the cpu 4 and the display data signal f applied from the video RAM 1. The blanking signal generated from the CRT controller 2 is added in a gate 10 to the output signal of the parallel-serial converter 8 to provide the video signal h applied to the CRT display unit 3. A display data latch 11 latches the display data signal f.

The operation of the prior art video display apparatus having the above construction will be described with reference to a timing chart of FIG. 2. A one-character display period i in FIG. 2 will now be considered. A display address signal c indicative of a display address-1 of a character to be displayed on the corresponding position of the CRT display unit 3 is applied from the CRT controller 2 to be applied through the address switch 5 to the video RAM 1 within a period j. A video RAM data signal or display data signal f indicative of a display data-1 corresponding to the given display address-1 appears from the video RAM 1. The display data signal f indicative of the display data-1 is loaded in the display data latch 11 with the timing of a parallel data load signal b. The output signal g of the latch 11 is applied to the character generator 6 and graphics generator 7 to be subjected to bit conversion and is then loaded in the parallel-serial converter 8 with the timing of the parallel data load signal b. With the timing of a shift clock signal a applied from the CRT controller 2 to the parallel-serial converter 8, the output signal of the converter 8 provides a video signal h which is applied to the CRT display unit 3.

In the meantime, a memory read-write address signal d indicative of a cpu address-1 is applied from the cpu 4 to the video RAM 1 through the address switch 5 within the remaining portion k of the one-character display period i. A data signal f indicative of a cpu data-1 corresponding to the cpu address-1 provided by the memory read-write address signal d appears from the video RAM 1 to be applied to the display data latch 11 and also to the data bus buffer 9 which is connected to the cpu 4 for data transfer.

Figure 2:
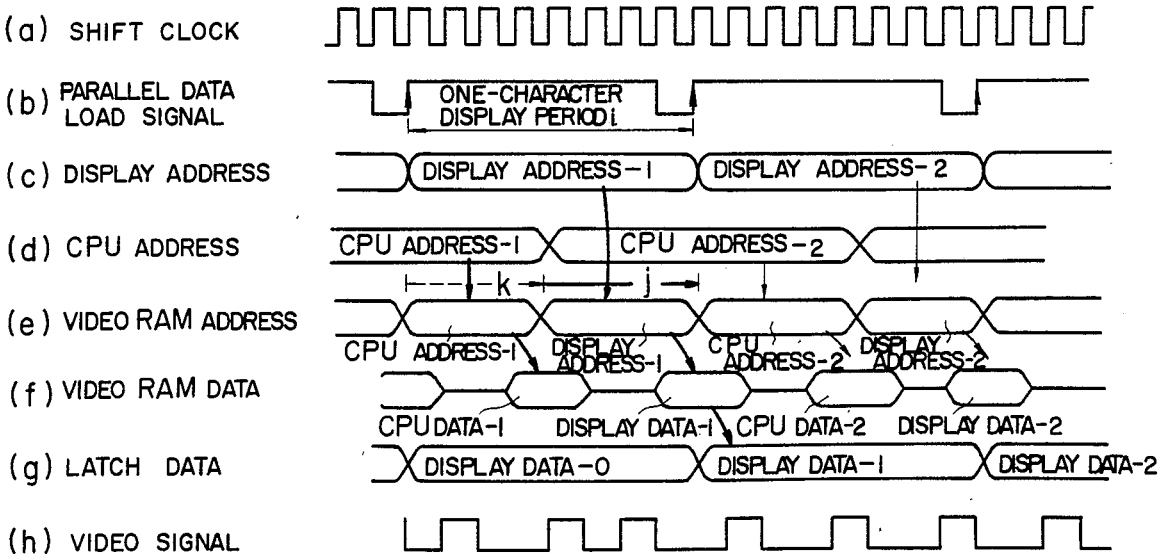
FIG. 2 PRIOR ART
FIG. 2 is a timing chart illustrating the operation of the prior art apparatus shown in FIG. 1.

According to the timing chart shown in FIG. 2, addresses are applied to the video RAM 1 by the repetition of the periods k and j. The minimum repetition period required for the address change is the shorter one of the periods k and j. This shorter period is the cycle time required for the video RAM 1. On the other hand, the one-character display period i in FIG. 2 is calculated as follows:

$$i = \frac{\dfrac{1}{\text{horizontal frequency (Hz)}} - \text{horizontal blanking time. (sec)}}{\text{number of horizontal displayable characters}} \quad (1)$$

Figure 3:
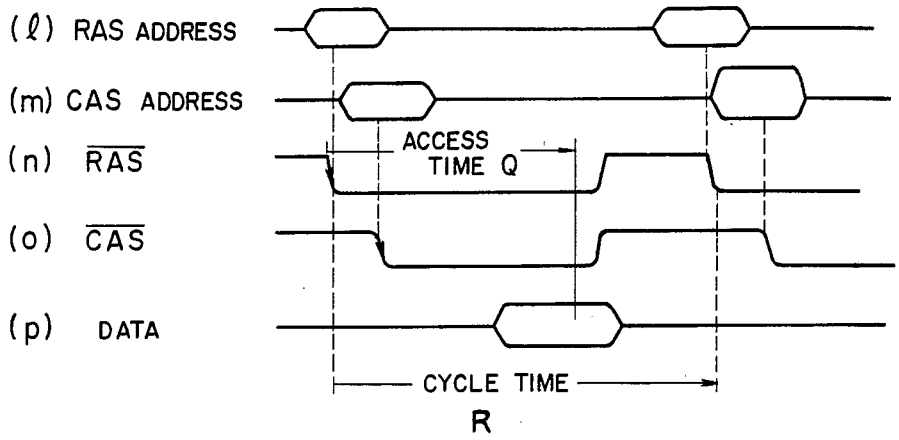
FIG. 3 is a timing chart illustrating the common practice of reading out data from a dynamic RAM.

In the case of a static random access memory, its cycle time is equal to the access time. However, in the case of a dynamic random access memory, it is a common practice to divide an address into an RAS address and a CAS address and to sequentially apply them as shown in FIG. 3. In this case, therefore, the minimum access time Q and the cycle time R are in no way equal to each other.

In the field of the raster scan display, it is a general tendency to increase the horizontal frequency for preventing flickering of the display. It is also a general tendency to increase the number of horizontal displayable characters. Consequently, the one-character display period i tends to decrease, as will be readily understood from the expression (1). This means that the cycle time required for the video RAM 1 in the timing chart of FIG. 2 decreases or is shortened inevitably. It can therefore be seen that an attempt to use, for example, a dynamic RAM as the video RAM 1 requires a dynamic RAM having a short cycle time. Suppose, for example, that the number of horizontal displayable characters is 80 at the horizontal frequency of 15.75 kHz and the blanking period of 15 μsec. Then, the one-character display period i calculated from the expression (1) is about 606 nsec. Suppose then that the period k is equal to the period i in the timing chart of FIG. 2. Then, the cycle time required for the video RAM 1 is as short as $606 \div 2 = 303$ nsec. To meet the above requirement, a high-speed dynamic RAM is required, and such a video display apparatus is very expensive.

Figure 4:
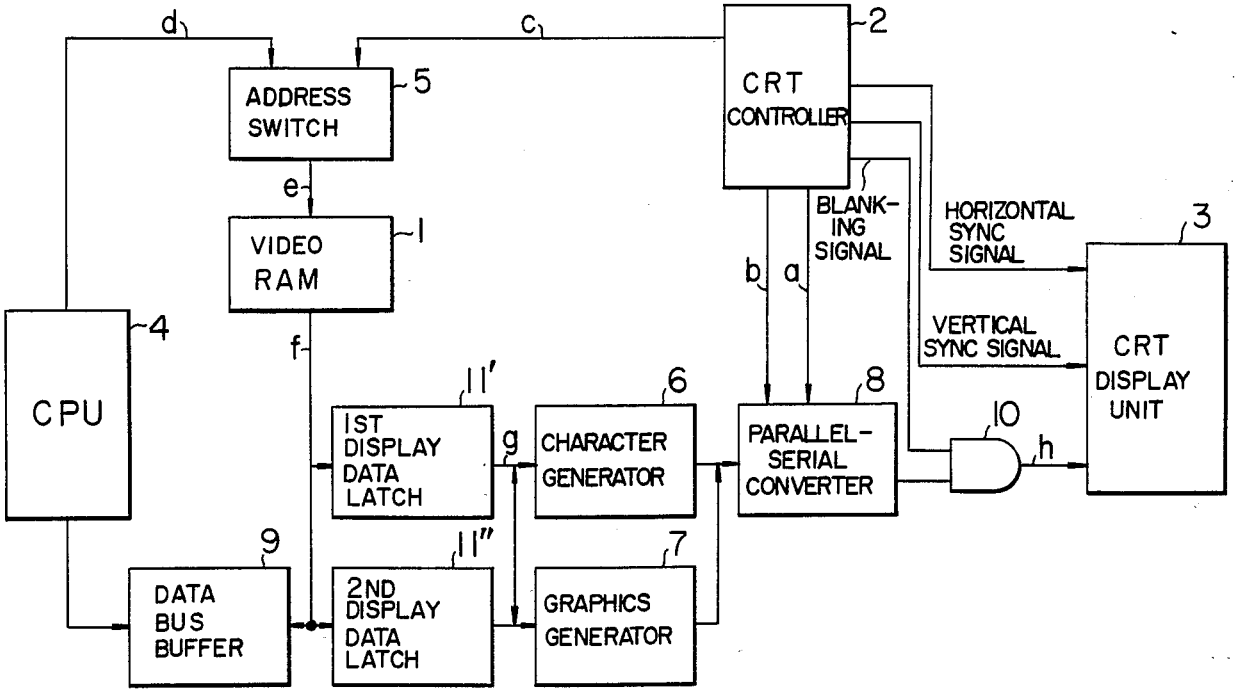
FIG. 4 is a block diagram of a preferred embodiment of the video display apparatus according to the present invention.
Figure 5:
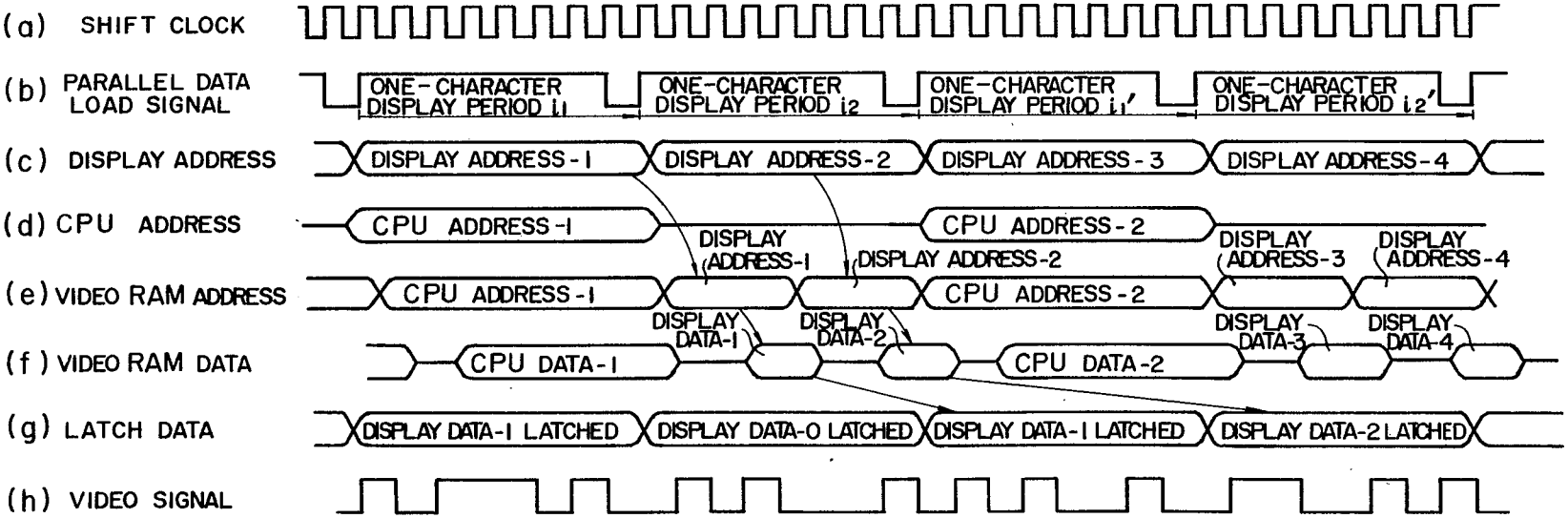
FIG. 5 is a timing chart illustrating the operation of the apparatus of the present invention shown in FIG. 4.

The present invention which obviates such a defect will now be described. FIG. 4 is a block diagram of a preferred embodiment of the video display apparatus according to the present invention, and FIG. 5 is a timing chart illustrating the operation of the embodiment shown in FIG. 4. In FIG. 4, the same reference numerals are used to designate blocks carrying out functions similar to those shown in FIG. 1.

Referring first to FIG. 5, two consecutive one-character display periods $i_1$ and $i_2$ are considered to be a basic repetition period. The former one-character display period $i_1$ is principally used as the period in which the cpu 4 in FIG. 4 makes its memory read-write operation on the video RAM 1. The latter one-character display period $i_2$ is allotted to the period in which display data are read out from the video RAM 1 under control of the CRT controller 2 in FIG. 4. In the first half of the one-character display period $i_2$, a display address signal c indicative of a display address-1 of a character to be displayed on the corresponding position of the CRT display unit 3 is applied from the CRT controller 2 to be applied through the address switch 5 to the video RAM 1. A display data signal f indicative of a display data-1 corresponding to the given display address-1 appears from the video RAM 1. This display data-1 is stored in a first display data latch 11'. In the latter half of this one-character display period $i_2$ too, a display data-2 corresponding to a display address-2 is similarly stored in a second display data latch 11''. In the succeeding one-character display period $i_1'$, the display data-1 latched in the first display data latch 11' appears as a latched data signal g from the first display data latch 11', and in the succeeding one-character display period $i_2'$, the display data-2 latched in the second display data latch 11'' appears as a latched data signal g from the second display data latch 11''. These latched data signals g are applied to the character generator 6 and graphics generator 7 to be subject to bit conversion and are then loaded in the parallel-serial converter 8 with the timing of the parallel data load signal b. With the timing of the shift clock signal a, the parallel-serial converter 8 converts the parallel data applied thereto into a serial data, and the resultant signal is applied from the parallel-serial converter 8 to the gate 10. The blanking signal applied from the CRT controller 2 is added to the output signal of the parallel-serial converter 8 to provide a video signal h applied to the CRT display unit 3.

Figure 6:
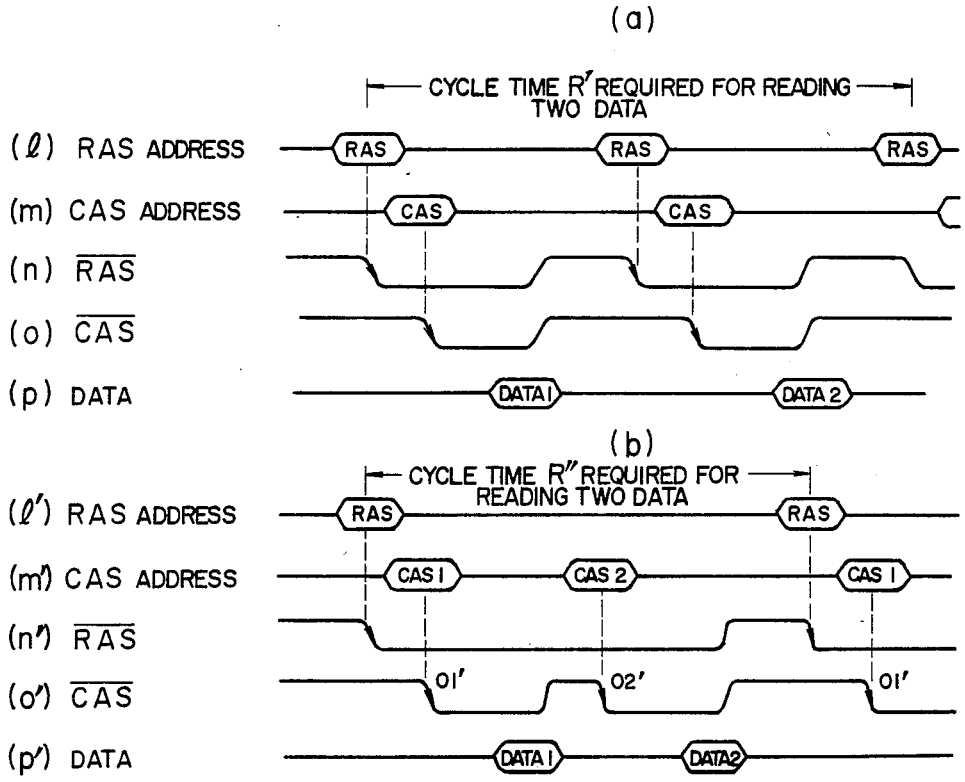
FIGS. 6*a* and 6*b* are timing charts illustrating how the cycle time can be shortened when the page read function of a dynamic RAM is utilized.

The construction shown in FIG. 4 differs from that shown in FIG. 1 in that display data, for example, a display data-1 and a display data-2 are consecutively read out from the video RAM 1 as shown in (f) of FIG. 5. Therefore, when a dynamic RAM is used as the video RAM 1 in the apparatus of the present invention shown in FIG. 4, the page read function of the dynamic RAM can be effectively utilized. This page read function will be briefly explained with reference to FIG. 6. FIG. 6(*a*) illustrates the general cycle of reading out data from a dynamic RAM. In FIG. 6(*a*), an address is divided into an RAS address and a CAS address, and these addresses are applied sequentially timing of signals $\overline{RAS}$ and $\overline{CAS}$ respectively to read out a data-1 and a data-2 corresponding to the applied addresses respectively. FIG. 6(*a*) illustrates the timing of consecutively reading out such data. It will be seen in FIG. 6(*a*) that the cycle time R' of illustrated length is required for reading out the data-1 and data-2.

On the other hand, FIG. 6(*b*) illustrates the timing of reading out such two data utilizing the page read function which is one of the functions of the dynamic RAM. In the timing chart of FIG. 6(*b*), an RAS address (l') is applied to the dynamic RAM with the timing of a signal $\overline{RAS}$ (n'). Then, a CAS-1 address is applied to the dynamic RAM with the first timing 01' of a signal $\overline{CAS}$ (0') to read out a data-1 corresponding to the address indicated by the RAS and CAS-1 addresses applied to the dynamic RAM. Then, after changing the level of the signal $\overline{CAS}$ (0') from its low level to its high level while maintaining the signal $\overline{RAS}$ (n') in its low level, a CAS-2 address is applied to the dynamic RAM again with the second timing 02' of the signal $\overline{CAS}$ (0') to read out a data-2 corresponding to the address indicated by the RAS and CAS-2 addresses applied to the dynamic RAM. The utilization of the page read function described with reference to FIG. 6(*b*) is advantageous in that two data can be read out within a cycle time R'' which is shorter than the cycle time R' required for reading out two data in the case of FIG. 6(*a*). It is to be noted, however, that it is necessary to read out two data by changing the CAS address only while maintaining the same RAS address when the page read function of the dynamic RAM is to be utilized.

According to the construction of the apparatus of the present invention shown in FIG. 4, display address signals are applied to the video RAM 1 over a one-character display period or more. For example, display address signals indicative of a display address-1 and a display address-2 are sequentially applied to the video RAM 1 in the former half and latter half of the period $i_2$ respectively as shown in (e) of FIG. 5. The display address-1 is divided into an RAS address and a CAS-1 address as shown in FIG. 6(*b*), and the display data-1 shown in (f) of FIG. 5 is read out on the basis of the RAS address and CAS-1 address. Then, while maintaining the existing state of the RAS address in the display address-1, the display address-2 including a CAS-2 address different from the CAS-1 address is applied to read out the display data-2. It is therefore possible to shorten the cycle time of the dynamic RAM used as the video RAM 1.

While the embodiment shown in FIG. 4 has referred to the use of two display data latches, it is apparent that the present invention is equally effective when more than two display data latches are used. The display data latch may be a memory of, for example, the FIFO (first-in First-out) type which stores data sequentially.

It will be understood from the foregoing description of the present invention that the read cycle time of a dynamic random access memory can be shortened, and, consequently, an inexpensive memory can be used as the video ramdom access memory.

I claim:

1. A video display apparatus comprising:

a video random access memory for storing data determining in a 1:1 relation at least one of characters and graphics which are to be displayed on a cathode-ray tube (CRT) display unit of the raster scan type:

a CRT controller which, in correspondence to data display positions on said CRT display unit, generates display addresses in successive one-character display periods, said CRT controller generating a first display address for a first one-character display period in a first half of a second, consecutive one-character display period and generating a second display address for a second one-character display period in a second half of the second one-character display period, the sum of the consecutive first and second one-character display periods forming one repetition period;

a CPU for controlling a read-write operation on said video random access memory and generating a CPU address for controlling a write operation to said video random access memory in said first one-character period;

address switching means having an input terminal connected to an address output terminal of said CRT controller and an address output terminal of said CPU and having an output terminal connected to an address input terminal of said video random access memory, for supplying the CPU address from said CPU to said video random access memory in said first one-character display period and supplying the first and second display addresses from said CRT controller to said video random access memory in said second one-character period;

a generator for generating at least one of characters and graphics, said generator generating a video signal for displaying at least one of characters and graphics in accordance with display data read from said video random access memory;

first latch means including a first-in, first-out memory having an input terminal connected to an output terminal of said video random access memory and having an output terminal connected to an input terminal of said generator, for latching first display data read from said video random access memory in the first half of said second one-character display period to supply the first display data to said generator in said first one-character display period; and second latch means including a first-in, first-out memory having an input terminal connected to the output terminal of said video random access memory and having an output terminal connected to the input terminal of said generator, for latching second display data read from said video random access memory in the second half of said second one-character display period to supply the second display data to said generator in said second one-character display period.

2. A video display apparatus according to claim 1, wherein said CRT controller generates a RAS address which is used in common as a part of said first and second display address through the first half and second half of said second one-character display period, a first CAS address which is used as a part of said first display address only in the first half of said second one-character display period, and a second CAS address which is obtained by increasing the content of said first CAS address by 1 and which is used as a part of said second display address only in the second half of said second one-character display period.

* * * * *